US006527270B2

(12) United States Patent
Maksymec et al.

(10) Patent No.: US 6,527,270 B2
(45) Date of Patent: Mar. 4, 2003

(54) METHOD OF EFFECTING MULTIPLE WAGERS ON A SPORTS OR OTHER EVENT

(75) Inventors: Peter Alex Maksymec, Las Vegas, NV (US); Allen Leroy Savage, Jr., Las Vegas, NV (US); William C. Wortman, Las Vegas, NV (US)

(73) Assignee: Casino Advisory Services, Inc., Las Vegas, NV (US)

( * ) Notice: Subject to any disclaimer, the term of this patent is extended or adjusted under 35 U.S.C. 154(b) by 0 days.

(21) Appl. No.: 09/782,821

(22) Filed: Feb. 13, 2001

(65) Prior Publication Data

US 2002/0153656 A1 Oct. 24, 2002

(51) Int. Cl.[7] ..... A63F 1/00
(52) U.S. Cl. ..... 273/138.1; 273/274; 463/16
(58) Field of Search ..... 273/138.1, 274, 273/139; 463/16, 17, 20

(56) References Cited

U.S. PATENT DOCUMENTS 4,252,321 A * 2/1981 Hopwood ..... 273/247
5,573,244 A 11/1996 Mindes
5,575,474 A 11/1996 Rossides
5,743,525 A * 4/1998 Haddad ..... 273/138.1
5,749,785 A * 5/1998 Rossides ..... 463/25
5,842,921 A * 12/1998 Mindes et al. ..... 463/16
6,126,543 A * 10/2000 Friedman ..... 273/139
6,296,251 B1 * 10/2001 Webb ..... 273/274

* cited by examiner

*Primary Examiner*—Benjamin H. Layno
*Assistant Examiner*—V K Mendiratta
(74) *Attorney, Agent, or Firm*—Quirk & Tratos

(57) ABSTRACT

A wagering system is provided in which the payment on either side of a "neutral" bet, or center point, increases as the amount of win or loss diverges from the center point. The system is particularly applicable to bets placed in legalized bookmaking establishments, which set a line for sports betting and permit bettors to wager on either side of the line. In a preferred embodiment, the amount of win or loss increases arithmetically with the departure of the final result from the center point. The system also includes the potential for placing caps (maximums) on the win/loss multiples, and providing cushions (i.e., deviations proximate to the center point) before which the increased wins and/or losses commence.

60 Claims, 4 Drawing Sheets

METHOD OF EFFECTING MULTIPLE WAGERS ON A SPORTS OR OTHER EVENT

FIELD OF THE INVENTION

This invention relates to a method of betting on the occurrence of a particular outcome of an event, such as a sports events. More particularly, it relates to a betting process on events in which the amount won or lost by a bettor is a function of the deviation of the final event result (e.g., score) from a previously predicted result (e.g. point spread). The method is principally applicable to sporting events.

BACKGROUND OF THE INVENTION AND SUMMARY

Betting on various types of events, such as sporting events, is a permitted activity in many parts of the world. In its simplest form, a bettor places a wager with a licensed establishment that a particular participant in a sporting event will prevail. If the bettor loses, the house keeps the amount bet. If the bettor wins, he is paid off according to a predetermined payout schedule, and the establishment will return to him the amount of the original bet plus some premium for having made a winning bet. In some instances, the payout schedule may include odds which will return a lower amount to the bettor if a favored team wins, or a higher amount in the event that an underdog team wins. The payout schedule may be also adjusted to keep a certain portion or percentage of the bet (vigorish) to compensate the house for taking risks and incurring costs associated with the wagering business. Alternatively, sometimes a commission only is charged.

Legalized bets can be made on any types of events, including political races, coin flipping, incidents of weather, event attendance, and almost any imaginable event where an outcome can be defined by a probability. Most legalized bets are made on sporting events, including football, basketball, baseball, soccer, tennis, boxing, hockey, horse racing, and the like. In the past, bettors have placed their bets prior to the commencement of the event, and expect to be compensated for a win in accordance with a known payout schedule. In some cases, however, the ultimate result of the event may become anticlimactic when one of the teams performs significantly better or worse than anticipated during the competition. For example, a football game may take three hours or more. If one team scores particularly heavily at an early portion of the game, from a bettor's perspective, the outcome of the bet is essentially determined. Thereafter, the bettor loses interest in the remainder of the game, and any excitement associated with respect to the bet is depleted at that point. In recognition of this problem, sports books have attempted to maintain this excitement throughout the game by offering new bets with new odds which can be made at half-time, or at the quarters of football games, or have offered proposition bets involving specific incidents which might take place during the game. However, these efforts have not met with great success, and most bettors remain interested in excitement associated with bets on the final outcome of the game.

In an effort to maintain excitement from a bettor's perspective in a sporting event, a betting method is set forth according to the invention in which the bettor can win or lose substantial amounts, relative to the initial bet, depending on the amount by which the final result of the game differs from the betting line (referred to in some cases as a "point spread" or "adjusted center point"). Bets according to the invention are made at the beginning of the sporting event, according to a win/loss schedule in which a bettor can win multiples of his initial bet if his team prevails by more points than the point spread, but can also lose multiples of his initial bet if his bet loses by more points than the point spread. According to the method of the invention, the larger the difference is between the final result and the point spread, the more a bettor will win or lose. Since these amounts can be substantial multiples of the original bet, a bettors interest is maintained until the very end of the event. For example, in a football game, a last-minute touchdown could result in an additional win or loss of many times (e.g., 7×) the original bet, and a last-minute field goal could similarly result in a payout swing of as much as a factor of three.

This system has the benefit of maintaining a bettor's interest in a sporting event all the way to the end of the event, even though the actual result of the event may have been determined hours earlier. This is attractive to bettors, who enjoy the thrill of the bet and will enjoy watching the entire event, to the finish. However, this system also is very attractive to the house, since many more bettors will be attracted to the high stakes win/loss multiple. For example, many sports bettors do their own betting research and are convinced that they have a better ability than the house to predict the outcome of a game. Indeed, the house typically sets the line on a game based on a projected neutral betting outcome, with a goal being to attract an equal amount of betting on either side of the line. Thus, the house sets the line based on the projected response from its bettors. Many bettors believe that they are smarter, or better informed, than other bettors, and will thus be greatly attracted to a betting system where, if they have bet correctly, they can win large multiples of their original bet. This opportunity is currently not available in sports betting venues.

In addition to sparking player interest, the system of the invention provides the house with significant deposits to cover maximum potential losses. This front money, when multiplied by a large number of bets which may not be settled for days or weeks, creates a fund which can generate substantial interest for the house. Furthermore, the overall betting pool becomes much larger, since wagers are automatic up to the maximum possible loss.

The system of the invention also provides excellent flexibility for the house to entice bettors to one side of a bet without moving the line. Normally, if betting becomes heavier on one side of the center point than the other, the house will move the center point to encourage bets on the other side. However, a significant move of the line leaves the house vulnerable to being "middled" on the bet.

For example, assume that in a football game, team A is favored over team B by seven points, the line being "Team A−7." If betting is disproportionately heavy on Team B, the house could move the line to "Team A−5" in an effort to attract more bets to Team A. However, if Team A wins by six points, the house would lose the initial bets on Team B as well as the bets on Team A after the line was moved.

Using the system of the invention, rather than moving the line, the house could attract bets to Team A by putting a cap on losses on bets on Team A (or making an existing cap on losses more favorable, e.g., by moving the cap from seven to five). Alternatively, the house could place a cushion on the multiple on wins for Team B. For example, the first multiple on winning bets on Team B could be moved to three points or more, but the multiple on wins for bets on Team A could remain at a margin of two points. These are examples of methods of the invention in which the bet can be balanced without moving the center point.

Accordingly, it is the general purpose and object of the invention to provide a betting process associated with a sporting event wherein, as a result of a bet made prior to the event, a bettor may win or lose substantial additional amounts based upon the departure of the actual outcome of the event from a predicted line or point spread. It is also an object of the invention to provide a betting system for sporting events wherein the final result of a player's bet may change significantly near the end of the sporting event, even though the actual result of the event may be foreseeable at a much earlier point in the event. These and other objects of the invention are accomplished by the betting system which is described more fully herein.

A betting system is provided in which bettors can place bets on the occurrence or non-occurrence of an event with an establishment (the "house"). Embodiments of the system include a win/loss pay table by which the bettors may win or lose substantial multiples of their original bets based on the deviation of the actual event outcome from the adjusted center point of the bet set by the house prior to the event (i.e., the win or loss margin).

For example, in a game of American football, after the house posts an initial betting line comprising a point spread, the bettor may bet on either team, obtaining or giving up a fixed number of points as determined by the published line. If the final game result deviates from the published line, the bettor may win double the payout associated with his initial bet if his team prevails by two points more than the point spread, triple his initial bet if his team prevails by three points more than the point spread, quadruple his initial bet if his team prevails by four points more than the point spread, etc. Conversely, the player may lose double his initial bet if his bet loses by two points more than the point spread, triple if his bet loses by three points more than the point spread, etc. Since the player is obligated to pay the house at the end of the game in the event of a loss, it will be customary for the house only to offer these bets to customers with established credit, or to customers who deposit the full amount of the potential loss with the house at the time the ticket is written.

In variations on the betting system, the house may provide "caps" on wins and losses to eliminate the possibility of extremely large wins or losses for either the house or for bettors in the event of aberrational final results. For example, the house may establish a limit of a maximum of wins or losses of five times, or ten times, the initial bet. In another modification of the system, the house can provide a "cushion" above or below the line before multiples of the bet will begin to apply. For example, in a football game, the win or loss may not multiply until the final result deviates from the line by a fixed number of points, which may be, for example, three, four, five, six, or seven points.

BRIEF DESCRIPTION OF THE DRAWINGS

The invention is better understood with reference to the drawings, in which.

DESCRIPTION OF PREFERRED EMBODIMENTS

Figure 1:
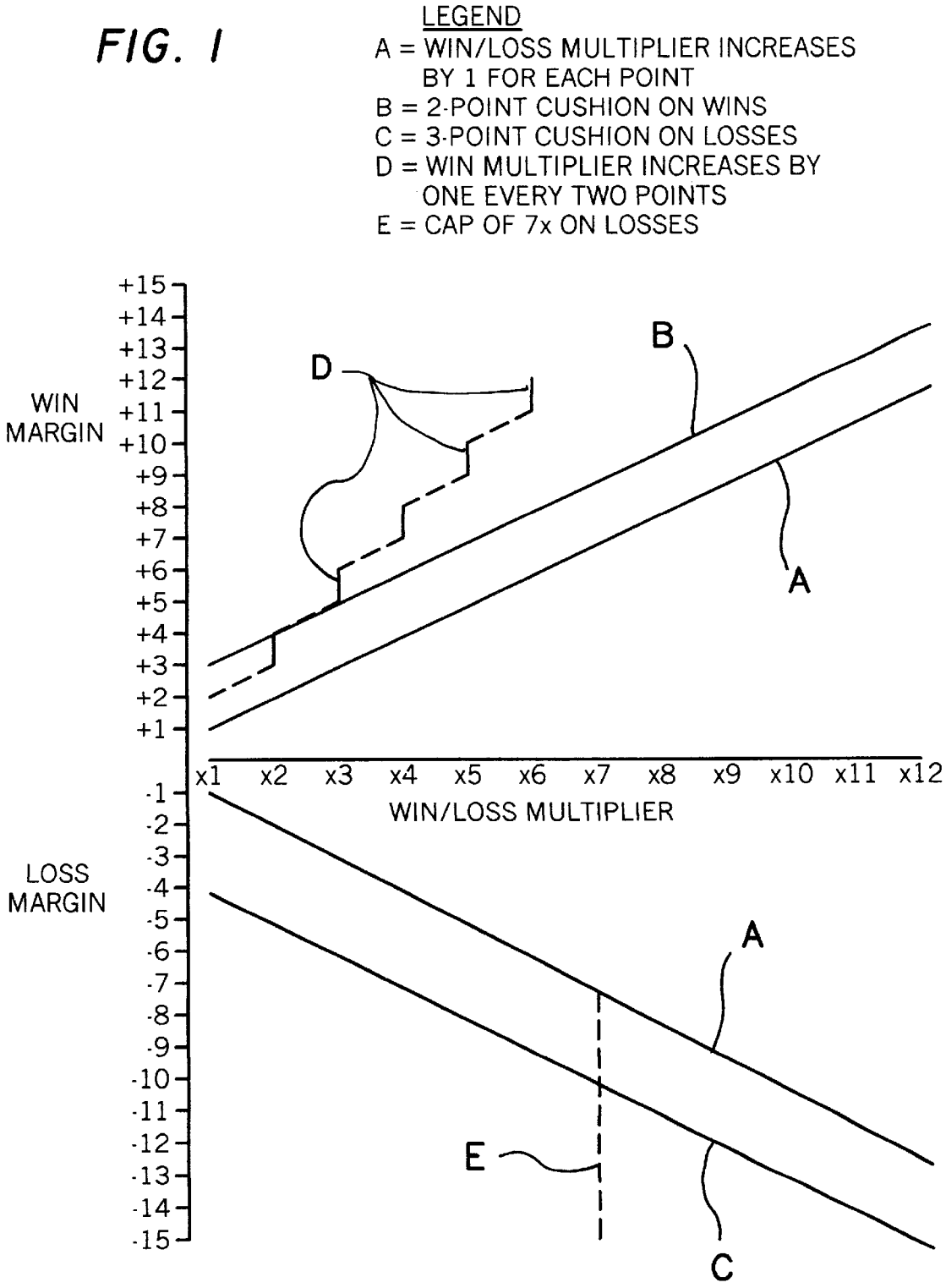
FIG. 1 is a graph showing various specific examples of payout tables of the betting system of the invention.

As previously indicated, the betting system of the invention is applicable for many different types of events, including sporting events, such as baseball, basketball, hockey, etc. Obviously, because the number of points scored in many of these events may vary widely from sport to sport, adjustments in the payout schedule will be made to reflect these differences. For example, the total score of both teams in a basketball game may be 100–200, whereas the total score in a hockey game is generally less than ten. Thus, win/loss multiples according to the invention would be lower for games in which a high number of points are expected, and higher in games where only a few points may be scored. For convenience, the betting system of the invention will be described with respect to the play of American football, with the understanding that it can be adjusted to apply to other sports.

In accordance with current practice, a sports book, or "house," offers bets on a wide variety of football games. Since the house must pay out winning bets, the house initially establishes a betting line, or "point spread," based on the projected outcome of the game. This line is established on the assumption that approximately an equal amount of bets will be received on either side of the line, thus minimizing the exposure to the house in the event that a line is set improperly, resulting a large imbalance of bettors betting on one team, thereby exposing the house to a significant loss.

In football, the line is established by requiring bettors on the favored team, or "favorite," to give up a fixed number of points, and allowing bettors on the team expected to lose ("underdog team") to add usually the same number of points to his team's score when determining the outcome of the bet. The number of points which bettors must give up when betting on a favorite, or add when betting on an underdog, is referred to as the "point spread." For example, if team A is favored by seven points over team B, bettors on team A would not win unless team A won by more than seven points, and bettors on team B would win if their team either won or lost by less than seven points. In this case, the point spread, which establishes a neutral bet for this game, would be "team A −7" or "team B +7, " the spread being seven points.

In prior art betting, if the line was bet "eleven to win ten" and $11 was bet, a winning ticket would pay a total of $21, representing a return of the original bet ($11) and the win amount ($10). In any case, only two results are possible: the bettor loses the entire amount of the bet, or wins a single known fixed amount. The amount won or lost does not depend upon the margin of victory or loss. If team A is ahead by 30 points in the first half, the outcome of the bet is usually determined, and the interest of the bettor in the game is lost.

The system of the invention renders the bettor's results dependent upon the deviation, or margin, of the final actual result of the game from the point spread. The larger a winning bettor's margin is from the point spread, the more money the bettor wins. Conversely, the more a losing bettor's bet deviates from the point spread, the more additional money will be lost.

The deviation, or margin, of the win or loss of a player's bet is the difference between the actual game result and the betting line. For example, if the betting line is "New York −7, " and New York wins by ten points, the margin (deviation) is plus three. If New York loses by ten, the margin is minus 17. As another example, if the betting line is "Miami +7, " and Miami loses by five, the margin is plus two. If Miami wins by two, the margin is plus nine. If Miami loses by nine, the margin is minus two. In this latter case, winning and losing bettors would have their wins or losses multiplied by a factor set out in the payout table. According to the invention, the greater the deviation between the game result and the betting line, the greater the winning payout and the greater the losing bettor's additional loss.

If a bettor deposits cash with the house representing the total potential loss on a bet, and the player wins or loses less than the deposit, then any excess deposit will be returned to the player at the end of the game.

The following examples illustrate specific ways in which the system of the invention may be implemented.

EXAMPLE 1

In a football game between team A and team B, team A is favored by three points, and team B is an underdog by three points. Thus, the spread, or "center point" of the bet, is "A−3." A bettor picks team A, and bets $11 to win $10. Under the predetermined payout schedule, if team A wins by four points (one more than the point spread), the bettor would win the return of his original bet ($11) and the win amount ($10). If team A won by five points (two more than the point spread), the bettor would win a return of the original bet ($11) plus double the win amount ($10×2=$20). If team A wins by seven points (four more than the point spread), the bettor would win $51 (a return of the original bet plus 4× the win amount).

If team A wins by the exact amount of the spread (three points), the bet is considered a "push" and the amount of the original wager is, in most cases, returned to the bettor. If team A only wins by two points, the bettor has not covered the spread and loses $11 (one times the bet). However, if team A wins by one point, the bettor has lost by a deviation of two points from the spread, and therefore loses twice his original bet, or $22. Continuing on with the progression, if team A loses by two points, the losing result would deviate by five points from the spread, and the bettor would lose five times the original bet, for a total of $55. By virtue of betting $11 to win $10, the house has an advantage to compensate for its service. In an alternative embodiment, the house may take a fee, e.g., 10% of the original bet, from winning payouts to pay for its services.

EXAMPLE 2

This Example assumes the same betting scenario and payout table as set forth in Example 1. However, a maximum limit, or "cap," is placed on the bettor's total potential win or loss on any single bet. If a bettor wins or loses his bet by an amount which exceeds the cap level, no additional winnings are collected, or losses paid. For example, if the cap was set at a multiple of ten, and the final result exceeded the point spread by ten points, winning bettors would receive their original bet of $11 back plus ten times $10, or $111, and losing bettors would lose ten times their original bet ($111). However, with a cap multiple of ten, if the final spread deviates by more than ten points, the maximum that a bettor would win would be ten times the initial potential win, and the maximum additional loss would be ten times the initial bet. The cap need not be the same for winning and losing bets. For example, the cap could be 10× for losses, and 20× for wins. In this case, the payout schedule may be adjusted by the house in some other manner to balance the winner's edge. Or, a cap could be offered on only one side of the bet to entice wagers to that side.

EXAMPLE 3

This Example also is based on the same line as set forth in Example 1. In the payout schedule of this embodiment, the house provides a margin or "cushion" of the amount of deviation, in addition to the point spread, before the multiple payouts or losses commence. In this example, the cushion is three points. Wins or losses within the cushion pay, or lose, 1× in the same manner as conventional betting. If team A wins by four, five or six points (one, two, or three points more than the spread), the bettor receives back his initial bet plus an additional $10, however, if team A wins by seven points (one point more than the spread plus the cushion), the bettor receives his initial $11 bet back plus a doubling of the initial potential win, or $31. If team A wins by eight points (two more than the spread plus cushion), he wins $30 plus his initial bet back. Similarly, multiples of the losses do not kick in until the cushion is exceeded.

In another embodiment of the example of a win/loss table having a cushion, when the multiple kicks in after the cushion, it may commence at the same multiple as the number above the point spread. For example, if the cushion is three and the point spread is minus three, a bet on team A would pay back at a multiple of one if team A prevailed by four, five, or six points, but would enjoy a multiple of four if team A won by seven points (four more than the spread). A similar schedule would apply for the loss side of the table.

The cushion need not be the same for winning and losing bets. For example, the cushion could be three points for winning bets, and five points for losing bets.

EXAMPLE 4

In this Example, the house bills the available bet as "team A, −3, 1/1,U/10,2/2." This indicates to the bettor that team A is "minus three," i.e., that team A is favored by three points. The "1/1" indicates the win/loss multiplier progression, i.e., each of the win/loss multiplier increases by a multiple of one for each point of deviation of the game result from the point spread. The indicator "U/10" denotes the cap for this particular bet. "U" indicates an unlimited positive multiplier (i.e., no cap on winning bets), and "10" indicates that the negative multiplier is capped at ten (i.e., that a bettor cannot lose in excess of ten times the original bet). The notation "2/2" denotes the cushion for this bet, indicating that the multiplier starts after two points for wins (the first digit) and two points for losses (the second digit).

As is apparent from the foregoing examples, substantial modification may be made within the spirit and scope of the invention, the concept of which involves increasing wins and losses resulting from a sports bet, depending upon the deviation of the final result from the initial line. For example, wins and losses need not multiply at the same rate. Furthermore, they need not increment at a uniform rate; smaller multipliers could apply if the point spreads deviate only a small amount from the spread, and larger multipliers or bonuses could apply to "blowout" wins and losses. Furthermore, the multipliers for wins and losses need not be integers, but can be fractional amounts. In determining a particular set of betting parameters for each bet, the house must of course take into account the probabilities of encountering exposure for the house which might make the parameters uneconomical.

The number of times that an award or payout increases, and/or that losing payments to the house increase, is a matter of choice depending on the type of bet and disposition of the house. It is possible to have only one or two increases, but three or more is preferred. The simplest method is to have the multiple of wins or losses increase arithmetically by one integer for each unit of deviation from the center point. A unit can be, e.g., a point for a football game, five points for a basketball game, or any measurable quantity on the continuum between the actual result and the center point.

As previously indicated, the bet multiplier need not increase uniformly with the margin. For example, it could double after two units, triple after five units, and quadruple after ten units. The flexibility of the system makes it especially adaptable to large numbers of betting situations.

The betting system of the invention has been described with respect to sporting events, which comprise a substantial amount of legalized betting worldwide. However, the system of the invention is also applicable to any type of wagering where the establishment, or house (e.g., any legal bookmaking business), can set a neutral wager on the occurrence of any event, and where bettors can bet against the house that such event will or will not occur. The betting system of the invention is then implemented to establish a payout table wherein the bettor's result depends upon the margin by which he has prevailed from the neutral wager, and the losing bettors additional losses depend upon the margin from the neutral bet by which he has lost.

Sporting events are easily handicapped, and a neutral wager (center point for the bet) established, by setting a betting line with a point spread as previously described. Other wagers can be handicapped depending on the type of wager. Examples of other types of events for which the betting system of the invention can be applied are horse racing; casino-type games, such as roulette, craps, keno, and card games; conventional lotteries, and bingo. The system can also be applied to legal betting on political races, stock market index, commodity prices, attendance at events, prize winners at dog shows, date of birth of a child, gallons of gas consumed in a specific period, or naturally occurring events, such as number of hurricanes during a season, number and intensity of earthquakes, temperature highs or lows in a specific period, average temperature in a month, inches of rain over a specific period, etc. Betting on these events is legal in numerous places in the world, and the system can be applied to any type of bet for which a neutral bet can be established by the house, so that bettors can wager on either side of the bet.

If the system were applied to a political race, if one candidate is favored, e.g., by 500,000 votes, the neutral bet can be set at this level, and the house can set a pay table to have the win/loss multiplier kick in at every 50,000-votes difference between the actual winning margin and the line.

In horse racing, the system could be applied in several ways. The book could put up the expected finish position of the horses in the race, and betting can occur on only one horse. Winning or losing wagers would calculate from the posted finish. For example, if the book lists a horse to finish fourth in a field of ten (representing the center point of the bet), and the horse finishes second, the payoff would be two times. If the horse finished seventh, the loss would be three times. Alternatively, the neutral bet could be set by the amount by which the horse won the race. A horse winning by two lengths would pay two times, and a horse losing by three lengths would lose three wagers.

For casino-type games, the additional wager can be added to the game layout. For example, in a roulette game, the neutral, or center point, for the wager would be 18/19. In one possible payout schedule, if the ball lands on 30, the player wins 11 times the wager. If the ball lands on ten, the loss is eight times.

For a craps game, the neutral wager would be seven. The bet can be set at $11 to win $10. If ten is rolled, the pay is three times. If two is rolled, the loss is five times.

In the game of keno, numbered ping pong balls (or the equivalent) are chosen, corresponding to consecutive numbers on the keno card. A bet can be made on the total of all of the balls which are drawn. For example, if 20 balls are pulled in a game having numbers 1–80, the average sum of the numbers on the 20 balls would be 800 (20×40). If the sum of all of the keno balls drawn adds up to 850, the house would pay 50 times the initial bet. If the sum was 780, the loss would be 20 times. The house may impose a cushion and/or a cap, or offer the player the opportunity to select a cap. Similar rules would apply if a particular game drew fewer balls; in this case, the neutral bet would simply be adjusted for the anticipated average total on the number of balls drawn for that particular game.

There may be numerous methods of applying the betting system of the invention to games of cards. For example, a new game can be developed in which a single card is drawn from a deck. Each deck comprises four suits of 13 cards per suit (ace through king, ace being low). The neutral bet could be placed at seven. If the player draws a jack, the pay is four times. If the player bets "over" and draws a two, the loss is five times.

In the game of blackack (21), a side bet can be made on either the player's hand or the dealer's hand. Multiples of win or loss would be calculated from the difference between the center point and the actual total; the player's hand could have a center point (neutral bet) of 17, whereas the dealer's hand may have a side bet of 20 (since the dealer is generally required to hit hands totaling 16 or less).

At the present time, lotteries are drawn in the same manner as keno balls. Thus, bets could be made on the total sum of the winning balls, as previously described. Alternatively, a bet could be made on whether the number of the first ball drawn is higher or lower than the center point.

Bingo is also a popular wagering game throughout the world. This game is similar to keno, in that numbers corresponding to those on the bingo cards are selected randomly through a random number generator, or through pulling numbered balls from a random ball selector. The same types of wagers can be made as were previously described for keno. Other side bets can also be created in accordance with the invention. For example, a wager can be placed that the winner will be called within a certain number of balls drawn, depending on the specific type of game played. The neutral bet would be determined for the specific game played, and bettors could wager on whether a winner would be chosen in a smaller or larger number of balls from the neutral number. The margin of the final result from the neutral number would determine the payout or loss multiplier. Another side wager that can be placed is on the number of the first ball drawn in the game. In conventional bingo, the numbers are selected from 1–75. A true neutral wager would be to select the center point at 37/38, where a bettor could bet on the number being less than 37 or more than 38, with the numbers 37 and 38 being ties. Multiples of win or loss would be calculated from this neutral center point.

Figure 2:
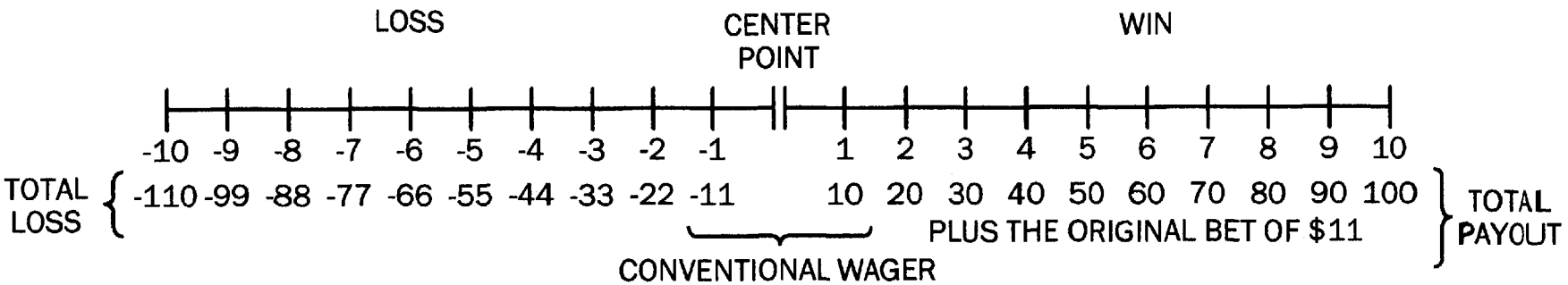
FIG. 2 is a chart showing a payout table showing win/loss multipliers and payouts for a typical "lay 11 to win 10" bet.

The betting system of the invention is applicable to any type of bet where a neutral wager or center point can be predetermined along a continuum of results, such as is illustrated in FIG. 2. This allows determination of a margin, or quantity of deviation, between the actual result of the event and the center point. The margin or deviation must be measurable in units in order to calculate the proper multiple of win or loss according to the invention. The units can be any definable quantity, depending on the bet, e.g., points in a sports event, lengths in a horse race, votes in an election, degrees of temperature, sum of numbers on ping-pong balls drawn, etc. These units can be placed along the continuum, with a center point for the wager established by the house.

The invention is also better understood with reference to FIGS. 1 and 2. FIG. 1 is a graph showing application of this betting system of the invention to a series of potential wager hypotheticals. The vertical axis of the graph shows the margin of win or loss of a bettor from the neutral bet, or center point. The horizontal axis shows the amount by which the bettor's win or loss is increased by a multiplier, in this case being a multiplier which uniformly increases depending on the win or loss margin. In lines denoted by "A" on the graph, the amount won or lost by a bettor would increase by a multiplier of one for each unit of win or loss from the neutral bet. Line "B" illustrates a similar situation, but with a two-point cushion on wins by one, two, or three points, the conventional one multiple is applied. If a team wins by four points, the bet is doubled. As shown in this particular payout schedule, the bet is tripled if the win is five points, quadrupled if the win is six points, etc. Thus, the house has a two-point cushion before the multiplier applies.

Referring still to FIG. 1, line "C" shows a three-point cushion on losses. If a bettor loses a bet by one, two, three, or four points, the multiplier is still one. However, for losses of five points or more, the multiplier will kick in according to the progression set forth in the drawing.

Line "D" of FIG. 1 shows a multiplier which increases by one integer every two points of margin from the neutral bet. If a player wins by one point, he would receive the payout according to a conventional bet. A player winning by three or four points would have the bet doubled. If the player won by seven or eight points, it would be quadrupled, etc.

Line "E" of FIG. 1 is an alternate embodiment of the table represented by line "A," wherein a cap of 7× is placed on losses. After the loss margin reaches minus seven units, losses are capped and the multiplier remains seven regardless of the increase in loss margin.

FIG. 2 is a chart showing the application of a payout table of the invention to a typical "lay 11 to win 10" bet. In a conventional wager, the bettor puts up $11 and bets on either side of the center point of the bet, which is the neutral bet determined by the house which, if achieved, would result in a player neither winning nor losing. In the conventional wager, the bettor puts up $11, and if he wins, the house returns $21 to him (the initial wager of $11, plus the win of $10). If he loses, the house keeps the $11. This is the result regardless of the margin between the actual winning or losing result and the center point, or neutral bet. Referring to FIG. 2, this is the result denoted "conventional wager" on the chart.

The remainder of the chart shows the payouts (or pay backs, in case of a loss) if the same "lay 11 to win 10" bet was made according to a payout schedule of the invention. Under this schedule, if the winning margin was one unit, the win would be $10, which is the same result as a conventional wager. However, if the winning margin were two units, the win would be $20, and the bettor would be paid $31 (the original bet of $11, plus the win of $20). If the winning margin were ten units, the win would be $111.

On the loss side of FIG. 2, the conventional payout table would allow the house to keep the bettor's initial $11, regardless of the deviation of the actual amount of the loss from the neutral bet. According to the payout table of this example, the initial wager of $11 is multiplied by an additional incremental integer for each unit of margin from the neutral bet. Thus, if the losing margin was two, the loss would be $22. If the margin were three units, the loss would be $33, four units would be $44, etc. This schedule compensates the house in a manner to which most bettors are accustomed, i.e., in multiples of the initial bet.

As previously indicated, the payout schedule need not be the same forwins or losses, and can provide for options for the bettor to select cushions before win and/or loss multiples kick in, or caps on wins and/or losses. From the standpoint of the house, the many variables that can apply to the payout schedule are calculated to provide adequate compensation for the house for offering the wagering opportunity, and taking the risk of an overall house loss in the event that the betting pool generated on any particular wager is unbalanced in favor of winners.

The Wagering System

In addition to the processes described above, embodiments of the invention include a wagering system as described below. The wagering system calculates betting options that can be presented by the house to bettors. These options provide a variety of bets for each game so that the gaming experience is enhanced for the bettors.

Figure 3:
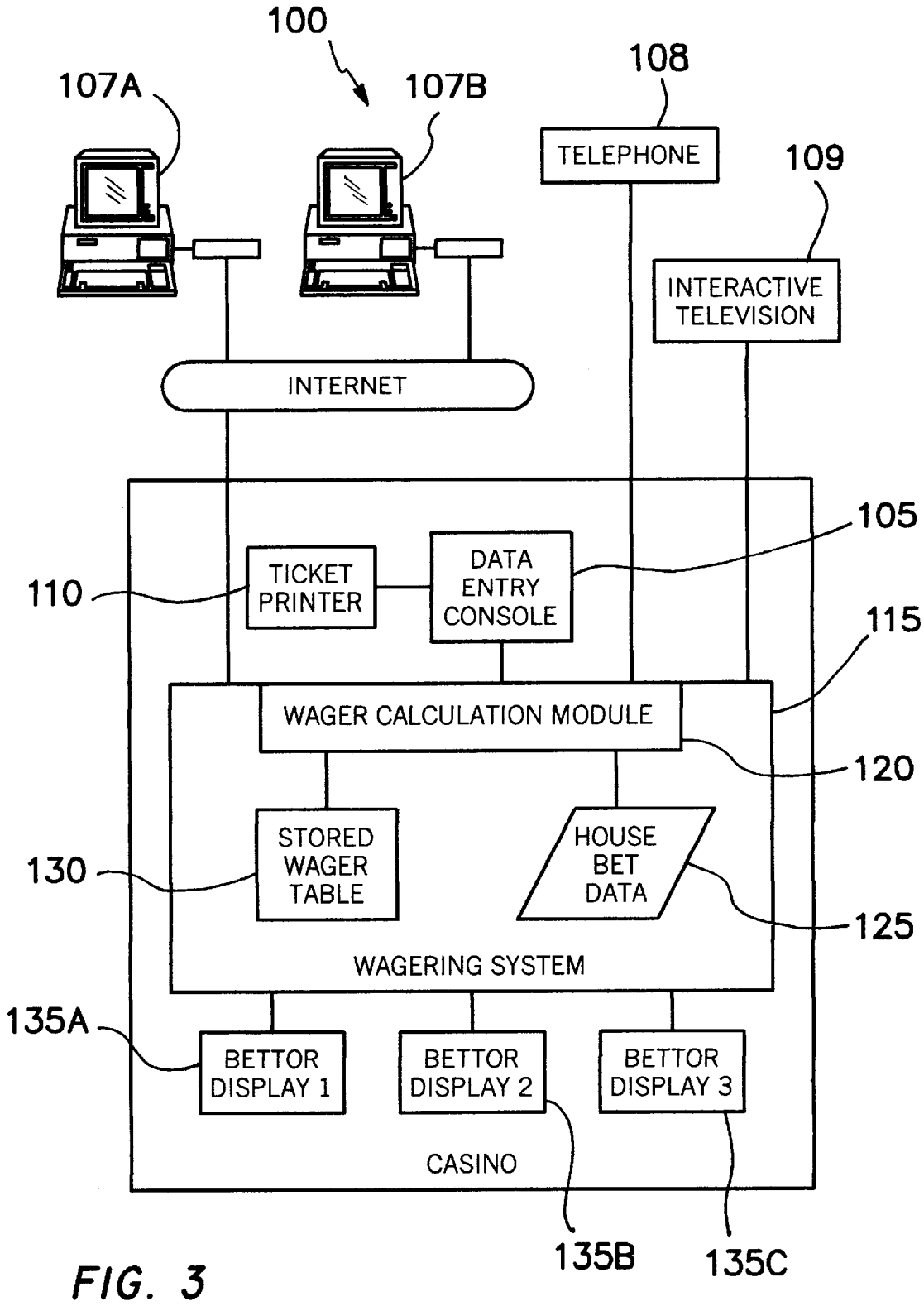
FIG. 3 is a block diagram illustrating one embodiment of a wagering system.

FIG. 3 is a block diagram showing one embodiment of a wagering system 100. The wagering system includes a data input system 105 that gathers betting information from a bettor. Typically, the data input system is located at the sports book within a casino. Conventional data input systems include keypads or other devices for entering betting data. Examples of other devices include telephone keypads, interactive television and any other means for transmitting data to the wagering system 100.

Of course, the invention is not limited to data input systems that reside within a casino. As illustrated, a set of personal computers 107A,B is linked through the Internet to the wagering system 100. Accordingly, betting data can be entered into the wagering system 100 by bettors having access to the Internet. In one embodiment, the personal computer is based on an Intel Pentium microprocessor running a conventional operating system such as Microsoft Windows, UNIX or Linux.

Other means of providing data to the wagering system 100 include a telephone 108 and interactive television 109. By pressing numbers on a conventional telephone keypad, the bettor can enter betting data into the system. Similarly, by using a television remote control or other connected device, a bettor can send data to the wagering system 100 through the interactive television 109.

The data input system 105 is also preferably linked to a receipt printer 110 that prints a receipt of the bet placed by the bettor. As discussed below, the receipt preferably includes the dollar amount bet and a description of the specific bet placed by the bettor. For example, the receipt might include the identity of the team, the point spread, the multiple corresponding to the amount won or lost for each point deviation from the spread, and the total cap on winnings or losses for the bettor. The receipt also preferably includes a tracking number that relates the printed receipt to a record stored within the wagering system 100. By entering the tracking number printed on the receipt the casino can retrieve and verify the bets printed on the receipt from the wagering system 100.

The data input system 105 and personal computers 107A,B are also linked to a main computer 115 that provides the wagering calculations described herein. In addition, the main computer provides a means for storing the betting data from the bettors so that the house can track bets on a particular game or event. In one embodiment, the main computer 115 is a server computer.

Within the main computer 115 is a wager calculation module 120 which includes software instructions for calculating, storing and presenting a variety of bets to a bettor. The wager calculation module can comprise instructions written in any conventional software language, such as C, C++, Visual Basic, Visual C or Java. In addition, the wager calculation module can reside as firmware within a programmable memory, such as an erasable programmable read only memory (EEPROM), an Application Specific Integrated Circuit (ASIC) or the like.

In the embodiment described in FIG. 3, the wager calculation module 120 gathers data from the house bet table 125 relating to the specific games that are to be played in the future. The house bet table stores a list of upcoming events, and the various bets that the house will accept for each event. Typically, the house bet data is calculated by an individual hired by the casino to set the odds for each event. The calculated data is then entered and stored to the house bet table. One example of the data stored in the house bet table is illustrated below.

TABLE 1

House Bet Data

| Event Unique Ident. | Team Code | Team Name | Pt Sprd | Win Incr. | Loss Incr. | Win Cap | Loss Cap | Win Cush. | Loss Cush. |
|---|---|---|---|---|---|---|---|---|---|
| 6464464 | 101A | Raiders | −3 | 1 | 1 | 10 | 10 | 2 | 2 |
| 6646477 | 101B | Raiders | −2 | 3 | 3 | 10 | 10 | 2 | 2 |
| 9372722 | 102A | Chargers | +3 | 1 | 1 | 10 | 10 | 2 | 2 |
| 3737838 | 102B | Chargers | +2 | 3 | 3 | 10 | 10 | 2 | 2 |
| 6922521 | 102C | Chargers | +4 | 7 | 3 | 5 | 5 | 3 | 3 |
| 8852234 | 102D | Chargers | +5 | 7 | 7 | 2 | 2 | 0 | 0 |
| 8866432 | 103 | Ravens | −9 | 1 | 1 | 5 | 5 | 0 | 0 |
| 8433854 | 104 | Dolphins | −5 | 1 | 1 | 20 | 10 | 1 | 1 |

As indicated in the house bet table, there can be various bets offered by the house for an event. Accordingly, Table 1 above illustrates that for the game between the Raiders and the Chargers, there are seven possible bets offered by the house. A bettor can bet on any combination of these bets. Because of the progressive and flexible nature of embodiments of the invention, the house is no longer limited to only accepting bets that a particular team will win or lose by the point spread.

For example, on the game between the Raiders and the Chargers, a bettor can place money on the first bet in the table (Unique Ident. 6464464). This bet would be made when a bettor believes the Raiders will beat the Chargers by a point spread of three. In addition, because the win and loss increments are one, the bettor will win or lose a multiple of their bet for each point of the final score that differs from the point spread. Since the win and loss multiples are set at 10, the bettor can't win or lose more than ten times their original win/loss bet amount. Also, since there is a win and loss cushion set at 2, the bettor will not win or lose a multiple of their bet until the final score of the game deviates from the point spread by more than two points.

Of course, a bettor might not like the parameters of this bet, and thus might choose any of the variety of bets offered by the house. Moreover, the house can easily add more bets to the house bet table prior to, or during, the game. For example, the house can add a new line in the House Bet Data table during a quarter or half-time period. This provides a simple and easy mechanism for the house to balance the money bet on each team. For example, if too many bettors are placing money on the favorite team, the house can add a new bet to the house bet table that would be attractive to bettors of the non-favorite team. In conventional casinos, if the money bet on two teams is unbalanced, the house typically moves the point spread prior to the game to attract more betting on the team with the lowest total money bet. Aspects of the present invention provide a means for the house to offer a wider variety of possible bets to attract bettors to bet on the outcome of an event.

Once betting data has been stored to the house bet table, the bettor can place a bet on one of the listed events. The bet is entered into the data entry console 105 by the bettor, or a clerk at the casino. Additionally, the bet can be accepted from one of the personal computers 107A,B through the Internet. Once a bettor has selected a particular bet, or combination of bets, from the house bet table, the wager calculation module calculates the total pledge that needs to be made by the bettor to cover any potential losses from the event. This process is described more completely in FIG. 4.

Once the bettor has selected each of their bets for the event, the main computer 100 assigns a Bet Identifier value to the bet and stores the bet data to a stored wager table 130. This table is used to track and maintain bets that are made by bettors. One exemplary stored wager table is shown in Table 2 below.

TABLE 2

Stored Wager Table

| Unique Bet Identifier | Total Amount Pledged | 1st Event Unique ID1 | 1st Event Amount Pledged | 2nd Event Unique ID1 | 2nd Event Amount Pledged |
|---|---|---|---|---|---|
| 14498418 | $165 | 6464464 | $110 | 8866432 | $55 |
| 12453332 | $110 | 5757555 | $110 | | |
| 99890765 | $275 | 8969666 | $220 | 6603898 | $55 |

The total bet pledged is the total amount of money given or promised to the house by the bettor. Because the house will typically want to be guaranteed to receive any potential losses up front, the total pledged amount includes these potential losses. Thus, referring to identifier 14498418, the bettor might enter an $11 bet to win $10 for a first event having an Event ID 6464464. In this bet there is a potential to lose 10× that amount ($110) due to the loss cap of 10 (See Table 1).

In addition, the bettor has placed a bet on a second event having Event ID 8866432, which also might be an $11 bet to win $10. Because event ID 8866432 has a loss cap of 5

(See Table 1), the total potential loss from this event is $55. Accordingly, the house will want to collect, or otherwise have guaranteed, pledged against, deposited or credited $110+$55=$165 from the bettor.

If the bettor wins the bet on event ID 8866432, the house will return the $110 and pay the bettor based on the final score of the game. If the Raiders should win by, for example, eight points, the house will pay the bettor $30 in addition to the returned $110. Because there is a two point cushion on this event, the winnings are not multiplied until the Raiders beat the Chargers by at least five points (three point spread plus two point cushion). Since the Raiders beat the Chargers by eight points, the win is calculated as 3×$10=$30 for winning by five points beyond the spread.

Once the wager data has been stored to the wager table 130, the data necessary for printing a bettor receipt is transmitted to the data entry system 105 or personal computers 107A,B. The data entry system then can print a receipt in order to provide the bettor with a hard copy of their bet. Of course, such printed receipts are not necessary if the bettor is betting electronically through the Internet. In that case, a receipt can be emailed, or presented as a Hypertext Markup Language (HTML) page to be displayed in the bettor's browser software.

Linked to the main computer 115 is a set of bettor displays 135A-C that are configured to display bets that have been made by a particular bettor. As can be imagined, a sports book can provide these displays so that individual bettors can track each of the bets they have made. A particular display is preferably assigned by the casino to a bettor, so that only the bets placed by the particular bettor appear on the display. One example of a particular display is presented below in Table 3.

TABLE 3

Example Bettor's Display

| Event Unique Ident. | Team Name | Pt Sprd | Win/ Loss Incr. | Win/ Loss Cap | Win/ Loss Cush. | Base Bet Amnt. | Real Time Win/Loss | Max. Win/Loss |
|---|---|---|---|---|---|---|---|---|
| 6464464 | Raiders | −3 | 1/1 | 10/10 | 2/2 | $11 | −$22 | $100/$110 |
| 6646477 | Chargers | −2 | 3/3 | 10/10 | 2/2 | $11 | +$10 | $30/$33 |
| 8866432 | Ravens | −9 | 1/1 | 5/5 | 0/0 | $11 | −$44 | $50/$55 |

This real-time updated display provides a bettor with the data such as their current win/loss positions based on the current scores of the games being played. In addition, this exemplary display also indicates the total possible amount that the bettor could win or lose for each game. Of course, the aspects of the invention are not limited to only this particular arrangement of information. Other displays including more or less information relating to bets made using embodiments of the invention are also contemplated. For example, the display can indicate in those events wherein the outcome particular bet is still pending. In one embodiment, the display will display an event in bolded or highlighted characters when the outcome of the bet has been determined. This might be when a particular game has ended, or at the end of a quarter or half-time period, depending on the bet placed by the bettor. In another embodiment, events where the outcome has not been determined can appear in blinking characters. Of course, any variation on the types of display indicators are contemplated in accordance with the above discussion.

Figure 4:
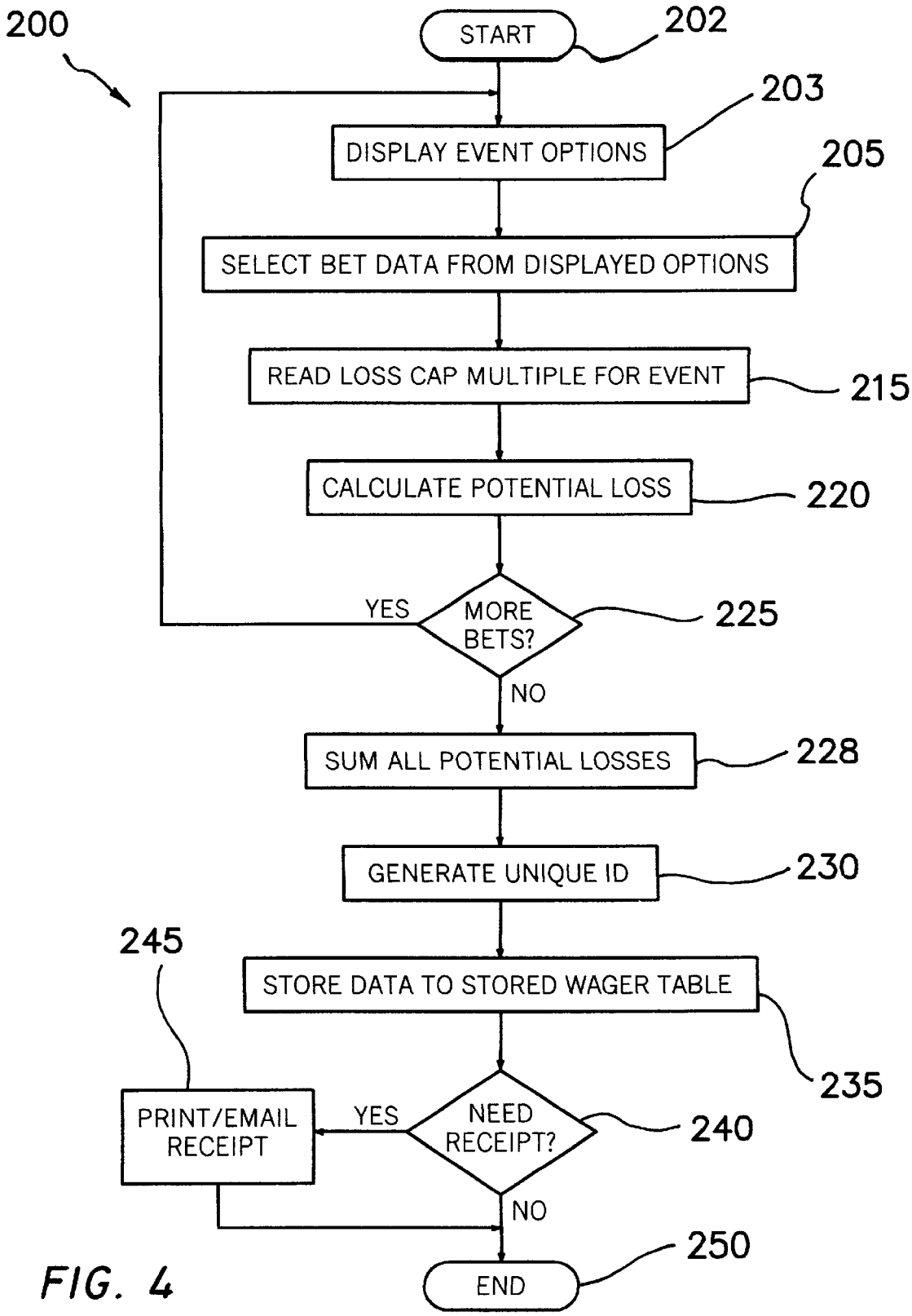
FIG. 4. is a flow diagram illustrating one embodiment of a process for calculating a wager within the wagering system.

FIG. 4 describes a wager calculation process 200 that runs within the wager calculation module 120. The wager calculation process 200 begins at a start state 202 and then moves to a state 203 wherein the bets available for each event are displayed to the bettor (or casino clerk). These events are retrieved from the house bet table and can be presented in order of the date of the event, the teams playing, or any other field within the house bet table. Once the events are displayed, the process 200 moves to a state 205 wherein a first event from the house bet table is selected by the bettor.

The process 200 then moves to a state 215 wherein the loss cap for the selected event is read from the house bet table. Once a loss cap has been read at the state 215, the process 200 moves to a state 220 wherein a calculation of the possible loss for this bet is determined. This calculation is made by multiplying the loss for the original bet amount by the loss cap.

Once the possible loss for the first event is determined, the process 200 moves to a decision state 225 to determine whether the bettor would like to select any other events to bet. If a determination is made that the bettor would like to bet on an additional event, the process 200 returns to state 203 wherein all of the potential bets are displayed. However, if a determination is made that there are no more bets to be made, the process 200 moves to a state 228 wherein all of the potential losses from each event are summed together to determine the necessary pledge amount.

A unique bet Identifier is then generated at a state 230 to uniquely identify this bet from all others stored in the main computer. Once the unique bet identifier has been generated, the process 200 moves to a state 235 wherein the event data is saved to the stored wager table.

A determination is then made at a decision state 240 whether or not the bettor requires a receipt for their bet transaction. If the bettor does want a receipt, the process moves to a state 245 wherein a receipt is printed on the printer 110, or emailed through the Internet to one of the personal computers 107A,B. The process 200 then terminates at an end state 250.

While the above discussion is relates to a system for storing bet data on a sports event, the invention is not so limited. The same system could provide a system for storing bet data on any type of event that occurs over a period of time. For example, the same system could store data relating to the outcome of an election wherein instead of team names, the system would store candidate names.

Although the invention has been described in detail with reference to certain particular embodiments thereof, it will be understood that any variations and modifications apparent to those of skill in the art will still fall within the spirit and scope of the invention. For example, the result-biasing system of the invention could be used in a non-wagering environment, for example, where awards or prizes are given in a free-entry or paid-entry contest. Such a contest could be run for a game or for an entire season of a sports league. Thus, it could be applied to any tournament or challenge, such as "fantasy football," or to handicappable contests not involving sporting events. Other embodiments not specifically described herein may fall within the spirit and scope of the present invention as provided by the following claims.

What is claimed is:

1. A method of conducting a wagering operation wherein an establishment accepts wagers on an outcome of an event, the event having a continuum of potential outcomes which are definable by units, the establishment setting a center point on the continuum, representing a likely outcome of the event, said center point separating the continuum into a first set of results and a second set of results, the establishment permitting a player to place a bet that the actual outcome of the event will be in the first set of results or the second set of results, the establishment keeping losing wagers and paying out winning wagers according to a payout schedule, the payout schedule including an award to a winning player of a multiple of the player's bet if the difference between the actual outcome of the event and the center point exceeds a first predetermined number of units, and also including an obligation of a losing player to pay an additional amount to the establishment if the difference between the actual outcome and the center point exceeds a second predetermined number of units.

2. The method of claim 1 wherein the event is a sports game, and the units are the difference in point scores of opposing game participants.

3. The method of claim 2 wherein the sports game is football, baseball, or basketball.

4. The method of claim 1 wherein the event is a naturally occurring event.

5. The method of claim 1 wherein the event is a casino game.

6. The method of claim 1 wherein the event is a horse race.

7. The method of claim 1 wherein the payout schedule also includes an award to a player of a second multiple of the player's wager if the difference between the actual outcome of the event and the center point exceeds a third predetermined number of units.

8. The method of claim 1 wherein the payout schedule also includes an obligation of a losing player to pay a second additional amount to the establishment if the difference between the actual outcome and the center point exceeds a fourth predetermined number of units.

9. The method of claim 1 wherein the payout schedule includes an award to a player of a second multiple of the player's wager if the difference between the actual outcome of the event and the center point exceeds a third predetermined number of units, and also includes an obligation of a losing player to pay a second additional amount to the establishment if the difference between the actual outcome and the center point exceeds a fourth predetermined number of units.

10. The method of claim 9 wherein the third predetermined number of units is equal to the fourth predetermined number of units.

11. The method of claim 1 wherein the payout schedule includes increasingly large awards to a winning player as the differences between the actual outcome and the center point increase, and an obligation of a losing player to pay increasingly large amounts to the establishment as the difference between the actual outcome and the center point increases.

12. The method of claim 11 wherein the payout schedule includes at least three increasingly large awards.

13. The method of claim 11 wherein the payout schedule includes at least three increasingly large amounts which a losing player is obligated to pay to the establishment.

14. The method of claim 11 in which the payout schedule includes increasingly large awards of 2×, 3×, and 4× the wager, and increasingly large amounts of 2×, 3×, and 4× the wager.

15. The method of claim 11 in which the payout schedule includes increasingly large awards of 2×, 3×, 4×, 5×, 6×, and 7× the wager, and increasingly large amounts of 2×, 3×, 4×, 5×, 6×, and 7× the wager.

16. The method of claim 1 wherein the payout schedule includes a plurality of multiples of the wager, and a maximum multiple of the wager which determines the maximum a player can win regardless of the actual outcome.

17. The method of claim 16 wherein the additional amount increases by multiples of the wager as the difference between the actual outcome and the center point increases, and wherein the payout schedule includes a maximum amount that the player can lose on the wager.

18. The method of claim 1 wherein the additional amount increases by multiples of the wager as the difference between the actual outcome and the center point increases, and wherein the payout schedule includes a maximum amount that the player can lose on the wager.

19. The method of claim 1 wherein payout schedule includes awards to a winning player which increase arithmetically as the number of units between the actual outcome and the center point increases.

20. The method of claim 19 wherein the payout schedule also includes a preset minimum number of units between the actual outcome and the center point before increased awards commence.

21. The method of claim 1 wherein the losing player is obligated to pay additional amounts which increase arithmetically as the number of units between the actual outcome and the center point increases.

22. The method of claim 21 wherein the payout schedule obligates the player to pay additional amounts only after the difference between the actual outcome and the center point exceeds a predetermined number of units.

23. The method of claim 22 in which the predetermined number of units is three.

24. The method of claim 22 in which the predetermined number of units is four.

25. The method of claim 22 in which the predetermined number of units is five.

26. The method of claim 1 wherein the payout schedule includes awards to a winning player which increase arithmetically as the number of units between the actual outcome and the center point increases, and wherein the losing player is obligated to pay additional amounts which increase arithmetically as the is obligated to pay additional amounts which increase arithmetically as the number of units between the actual outcome and the center point increases.

27. The method of claim 1 wherein the first predetermined number of units is equal to the second predetermined number of units.

28. A method of conducting sports wagering in which an establishment accepts wagers on two opposing sports participants, wherein the participant scoring the most points is the winning participant, a final score of each of the participants constituting a game result, comprising the steps of:

the establishment setting a betting line wherein a bet on a favored participant wins only if the favored participant prevails by more than a preset number of points, and a bet on an underdog participant wins if the underdog wins, or does not lose by more than the preset number of points, said preset number of points defining the betting line;

the establishment permitting a player to place a bet with the establishment on the favored participant or the underdog participant, the establishment keeping losing bets and paying out the player's winning bets according to a payout schedule;

the payout schedule including paying a winning player increasingly large payouts as the deviation between the game result and the betting line increases, and obligating a losing player to pay an additional amount to the establishment, said additional amount increasing as the deviation between the game result and the betting line increases.

29. The method of claim 28 wherein the sports participants are football, baseball, or basketball teams.

30. The method of claim 29 wherein the sports participants are football teams.

31. The method of claim 28 wherein the payout schedule also includes payout of a second multiple as the deviation increases.

32. The method of claim 28 wherein the payout schedule also includes a second additional amount as the deviation increases.

33. The method of claim 28 wherein the payout schedule includes at least three increasingly large payouts.

34. The method of claim 28 wherein the payout schedule includes at least three additional amounts which the losing player is required to pay to the establishment.

35. The method of claim 28 wherein the payout schedule includes at least three increasingly large payouts, and at least three additional amounts which the losing player is required to pay to the establishment.

36. The method of claim 28 wherein the payout schedule includes payouts of 2×, 3×, and 4× the player's wager.

37. The method of claim 28 wherein the payout schedule includes additional amounts of 2×, 3× and 4× the player's wager.

38. The method of claim 28 wherein the payout schedule includes payouts of 2×, 3×, and 4× the player's wager, and also includes additional amounts of 2×, 3× and 4× the player's wager.

39. The method of claim 28 wherein the payout schedule includes payouts of 2×, 3×, 4×, 5×, 6× and 7× the player's wager.

40. The method of claim 28 wherein the payout schedule includes additional amounts of 2×, 3×, 4, 5, 6× and 7× the player's wager.

41. The method of claim 28 wherein the payout schedule includes payouts of 2×, 3×, 4×, 5×, 6× and 7× the player's wager, and also includes additional amounts of 2×, 3×, 4×, 5×, 6× and 7× the player's wager.

42. The method of claim 28 wherein the payout schedule includes a maximum payout.

43. The method of claim 28 wherein the payout schedule includes a maximum additional amount.

44. The method of claim 28 wherein the payout schedule includes a maximum payout, and a maximum additional amount.

45. The method of claim 28 wherein the payout schedule includes payouts which increase arithmetically with the deviation.

46. The method of claim 45 wherein the payout schedule includes a maximum payout.

47. The method of claim 28 wherein the additional amount increases arithmetically with the deviation.

48. The method of claim 47 wherein the payout schedule includes a maximum additional amount.

49. The method of claim 28 wherein the payout schedule includes a predetermined minimum deviation prior to the payout increasing above the amount of the wager.

50. The method of claim 28 wherein the payout schedule includes a second predetermined minimum deviation prior to obligating a losing player to pay an additional amount.

51. The method of claim 28 wherein the payout schedule includes a predetermined minimum deviation prior to the payout increasing above the amount of the wager, and a second predetermined minimum deviation prior to obligating a losing player to pay an additional amount.

52. The method of claim 51 wherein the predetermined minimum deviation is equal to the second predetermined minimum deviation.

53. A system for accepting a wager on a sporting event involving two opposing teams, comprising:

a main computer comprising stored bet data, wherein the bet data includes an event identifier and a point spread value representing the amount by which one team is favored to win; and instructions for accepting a bet amount on the event and calculating a potential amount won by a winning bettor by determining a difference between the point spread value and the actual score at a predetermined time in said event, and for multiplying the bet amount by a first factor and by said difference, and instructions for calculating a potential amount lost by a losing bettor by multiplying the bet amount by a second factor and by said difference.

54. The system of claim 53, wherein said bet data includes a cap value, and said potential amount lost does not exceed said cap value.

55. The system of claim 53, wherein said bet data includes a cap multiple value, and said potential amount lost does not exceed said amount bet times said cap multiple value.

56. The system of claim 53, wherein said bet data includes a cushion value and wherein said difference is reduced by said cushion value prior to multiplying the bet amount by the difference.

57. The system of claim 53, wherein said bet data includes a multiplier value and wherein said difference is divided by said multiplier value prior to multiplying the bet amount by the difference.

58. The system of claim 53, wherein said system is linked to the Internet.

59. The system of claim 53, wherein said predetermined time is at the end of the sporting event.

60. The system of claim 53, wherein said predetermined time is at half-time of the sporting event.

* * * * *